United States Patent [19]

Pancook et al.

[11] Patent Number: 4,520,247

[45] Date of Patent: May 28, 1985

[54] PENDANT TYPE ELECTRICAL SWITCHING DEVICE

[75] Inventors: James J. Pancook, Tonawanda; Otmar M. Ulbing, Fairport, both of N.Y.

[73] Assignee: Columbus McKinnon Corporation, Amherst, N.Y.

[21] Appl. No.: 586,217

[22] Filed: Mar. 5, 1984

[51] Int. Cl.[3] ..... H01H 9/04; H01H 13/72

[52] U.S. Cl. ..... 200/298; 200/72 R; 200/276; 200/302.2; 200/303

[58] Field of Search ..... 200/276, 298, 302.2, 200/303, 159 R, 72

[56] References Cited

U.S. PATENT DOCUMENTS

| | | | |
|---|---|---|---|
| 2,374,435 | 4/1945 | Jordan | 200/72 R |
| 2,579,168 | 12/1951 | Ballou | 200/328 |
| 2,624,808 | 1/1953 | Anderson | 200/159 R |
| 2,750,480 | 6/1956 | Freeman | 200/298 |
| 2,752,463 | 6/1956 | Staak | 200/302.2 |
| 2,791,665 | 5/1957 | Baumbach | 200/298 |
| 2,832,849 | 4/1958 | Walter | 200/298 |
| 2,891,132 | 6/1959 | Devonshire et al. | 200/298 |
| 3,086,090 | 4/1963 | Carroll | 200/298 |
| 3,126,467 | 3/1964 | Stevens | 200/302.2 |
| 3,749,870 | 7/1973 | Oakes | 200/302.1 |
| 3,927,284 | 12/1975 | Anderson | 200/159 R |
| 4,063,054 | 12/1977 | Hirata | 200/159 R |
| 4,209,681 | 6/1980 | Somborn et al. | 200/298 |
| 4,356,367 | 10/1982 | Moldenhauer | 200/298 |
| 4,361,312 | 11/1982 | Schreyer et al. | 254/276 |

*Primary Examiner*—John W. Shepperd

*Attorney, Agent, or Firm*—Bean, Kauffman & Bean

[57] ABSTRACT

An electric switching apparatus having a trough-shaped body member formed of tough, non-conductive, flexible and substantially fully resilient material within which are seated a plurality of switching mechanisms. A pair of tubular shaped sheath members formed of flexible highly resilient non-conductive material snugly encompasses the device in weatherproof electrically insulated manner; portions of said sheath members being shaped to simulate manually push-operable button devices for actuating said switching devices.

11 Claims, 9 Drawing Figures

5
5

PENDANT TYPE ELECTRICAL SWITCHING DEVICE

BACKGROUND AND OBJECTS OF THE INVENTION

This invention relates to electrical switching devices, and more particularly to pendant type switch devices for control of electric hoists or cranes or the like such as disclosed for example in U.S. Pat. Nos. 2,791,665; 2,891,132; 3,086,090; 3,749,870 and 4,356,367. Such a switch is typically suspended from an overhead hoist motor or the like by a support wire or cable; is electrically interconnected with such motor by a plurality of conductors which may be incorporated in a single cable along with the support wire or cable, and is operationally held in the operator's hand. However, when the switch is not being operated, it will usually be left dangling on its support cable which in some cases is long enough to permit the switch when dropped to fall to the ground. Hence, for example, in a typical factory operation the switch is often slammed against various objects and is a good part of the time left either swinging on its cable above the floor level or lying on the floor; so that in either case it is exposed to buffeting such as by passing lift trucks or the like.

It is a primary object of this invention to provide an improved switch device of this type which is less subject to damage from abusive treatment such as above described, and which is fully electrically insulated and more readily field exchangeable than such switches of prior designs.

Another object is to provide an improved switch device as aforesaid which includes a "multiple speed" control feature.

Another object is to provide an improved switch device as aforesaid which includes a precise load lowering control system.

Still another object is to provide a switch device as aforesaid which is more readily operable by personnel wearing hand gloves.

Other objects and advantages of the invention will appear from the following specification and the drawing herewith.

BREIF SUMMARY OF THE INVENTION

The switch of the invention comprises a body member formed of tough, non-conductive, flexible and fully resilient material, which is cavity-shaped along one side and formed with a plurality of apertures leading from the other side into said cavity. Switching devices are mounted within the cavity portion of the body for multi-speed, reverse direction and precise load lowering control of the connected hoist. A cover plate formed of tough, non-conductive resilient material covers the cavity portion of the body member. A pair of tubular-shaped sheath members formed of resilient, non-conductive material snugly encompass the device in weatherproof, electrically insulated manner. The aperture covering portions of one of said sheath members is resiliently set into shaped configurations simulating manually push-operable button devices, and a novel progressively operable multi-speed form of switching mechanism is disposed thereunder. At one end the body member is apertured to receive the conductor bundle extending from the hoist and the bundle terminates in detachable electrical connections with the switches inside the cavity. The sheath members and conductor connection devices cooperate so that field disconnects and/or replacements of the switching mechanism vis-a-vis the conductor bundle are facilitated.

DETAILED SPECIFICATION

Figure 1:
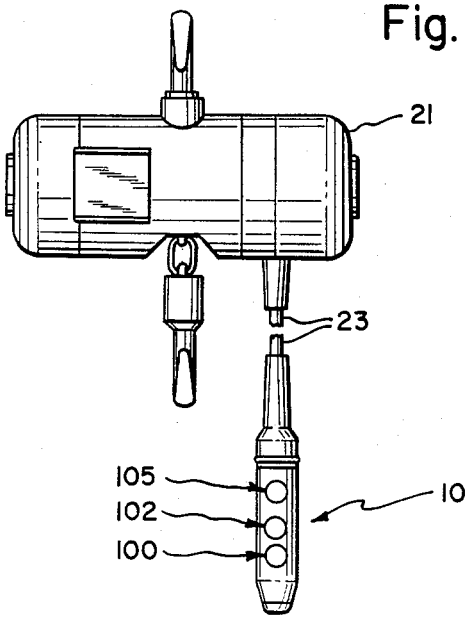
FIG. 1 is a small scale composite elevational view of an electric hoist and a pendant control station of the type to which the present invention is applicable.

The preferred form of "pendant" type control switch or "station" of the invention is illustrated in the drawing herewith as comprising an elongate generally trough-like body member 10 which is molded of a relatively stiff but elastomeric non-electrical conducting material such as a Nitrile or BUNA N (a copolymer of butadiene and acrylonitrile) or the like, to include continuous opposite side wall portions 12 and 12; a bottom wall portion designated generally at 14*a;* a front wall portion designated generally at 14*b;* and a series of spaced abutments or body portions 16, 18 and 20. This control station is adapted to be suspended from a hoist frame or the like such as is shown at 21 (FIG. 1) by means of a flexible "strain relief" stranded cable or wire or the like as illustrated at 22 (FIGS. 2, 4, 5 and 6). The cable 22 preferably comprises the core of a single cable assembly 23 which also includes insulated electrical conductors 24,25,26 leading to/from the hoist motor/brake control system (not shown), as is known in the art and are shown for example in U.S. Pat. Nos. 2,750,480; 2,791,665; 2,891,132 and 3,086,090.

The open cavity 10*a* of the molded body member 10 is provided with a removable cover plate 27 which is also molded of a relatively stiff but elastomeric non-electrical conducting material such as a Nitrile or BUNA N. The generally closed front wall portion 14*b* of the body member 10 is however longitudinally apertured or slotted as shown at 28 (FIGS. 3, 4, 5 and 7) to accommodate therein for example a coil spring 30 which is supported at its opposite ends by means of abutments 31,31 extending from the abutments 16 and 18 (FIG. 4) and comprises an electrical conductor portion of the control system of the device, as will be described more fully hereinafter. Incidentally, in lieu of a coil spring as shown herein, the member 30 may be of any other suitably resilient electrically conductive type, such as a leaf spring, or as a tube or rod of electrically conductive plastic. This same front wall portion of the body member is cylindrically countersunk or apertured as shown at 32, 34 and 36 (FIGS. 3, 4 and 7) for purposes to be explained hereinafter, and the body member 10 and its closure plate 27 are thus formed for enclosure therein of the electrically conductive components of the control station.

Figure 3:
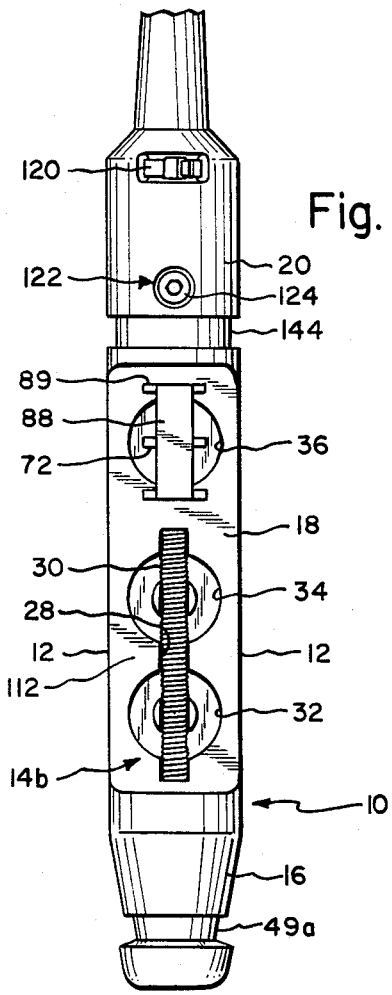
FIG. 3 corresponds to the main body portion of the device of FIG. 2 upon having the resilient cover members of the device peeled away therefrom.
Figures 4, 5, 6, 7, 8, 9:
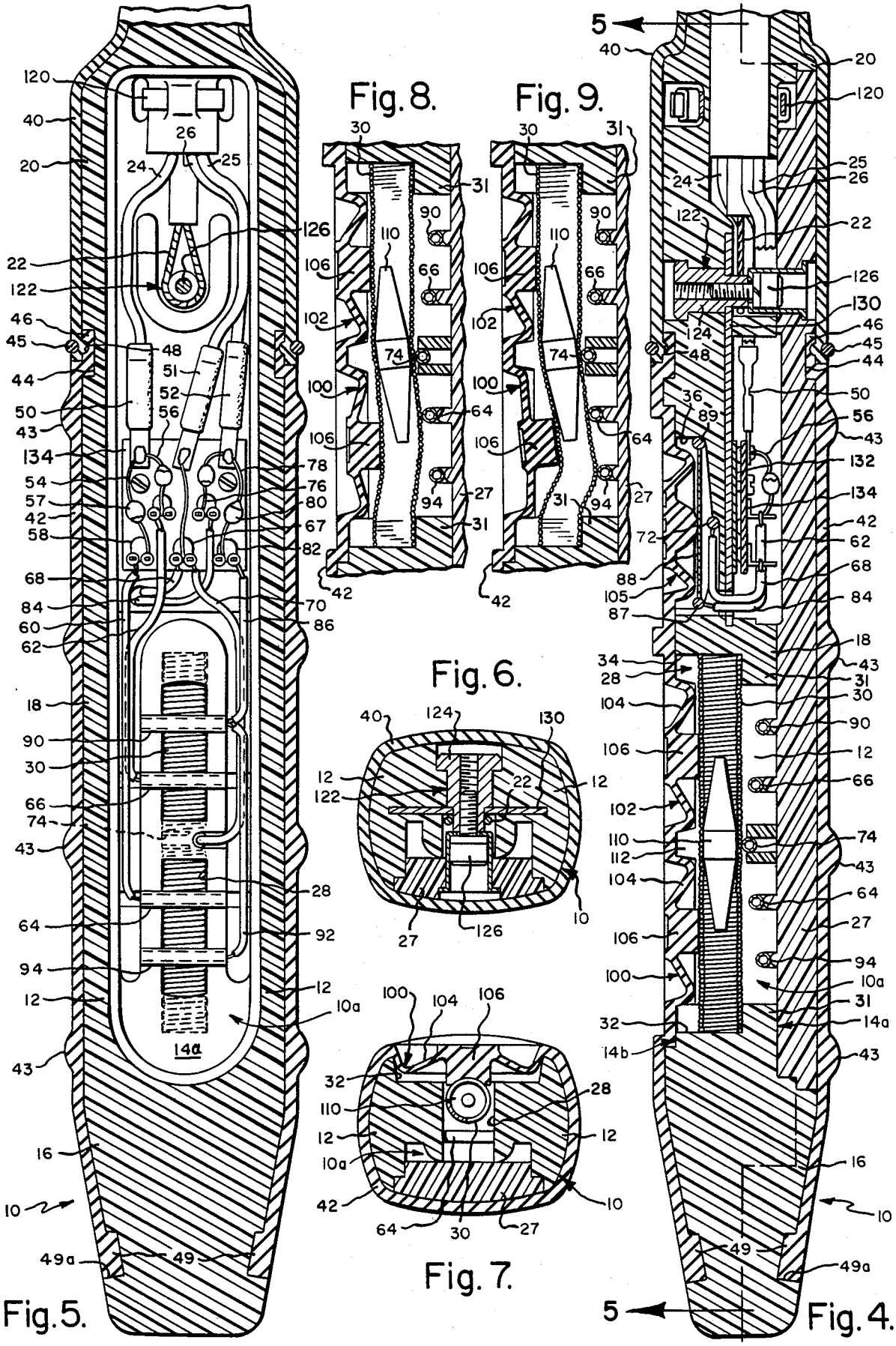
FIGS. 4 and 5 are enlarged scale sectional views taken as along lines 4—4 and 5—5 of FIGS. 2 and 4, respectively, the control switch parts thereof being shown in "neutral" inoperative position.
FIGS. 6 and 7 are enlarged scale sectional views taken as along lines 6—6 and 7—7, respectively, of FIG. 2.
FIGS. 8 and 9 are slightly reduced scale fragmentary illustrations corresponding to a portion of FIG. 4 showing the control switch parts in low speed "down" and high speed "down" positions, respectively.

A two-part highly resilient and non-conductive type sheathing arrangement comprising an upper sheath member 40 and a lower sheath member 42 is provided to weatherproof and thoroughly insulate, as well as to firmly encompass and lock together the entire assembly. Both sheath members are molded of Neoprene (a chloroprene) or the like, and as shown at 43 the member 42 is molded to include a series of vertically spaced apart projecting ridges to facilitate hand-holding of the device by the control station operator. As best shown at FIGS. 3, 4 and 5, the abutment 20 of body member 10 and cover plate 27 are formed to provide a peripherally extending mounting groove 44 into which the lower end of the sheath 40 is locked as by means of an elastic "O" ring 45. The lower sheath member 42 is initially force-fitted upwardly over the bottom end of the member 10 until an internal flange portion 46 at the upper end thereof latches into the groove 44. The flange 46 is peripherally grooved as shown at 48 to provide for locking depression thereinto of the lower end of the upper sheath member by means of the "O" ring 45. The lower end of sheath member 42 is also provided with an inwardly extending flange portion 49 which snap-fits into a complementary shaped mounting groove 49*a* around the lower end of the body portion 16.

In addition to the fact that the entire body and cover components of the device are formed of such materials as to be non-permanently deformable, such as by being battered or otherwise abused while at the same time providing maximum insulation and weatherproofing for its contents, the invention features provision of a highly improved internally located switching mechanism possessing unique accidentally distorted restoration capabilities. As shown at FIGS. 4 and 5, the conductors 24,25,26 leading from the controller to the hoist "lift and lower" and brake control systems are arranged to slip-fit "plug" into receivers 50,51,52, respectively. As best shown at FIG. 5, the receiver 50 leads to a pair of conductors 54,56 each of which includes a diode 57 and a terminal 58, from which extend conductors 60,62. In turn, the conductor 60 leads to slow speed "down" contact bar 64 and the conductor 62 leads to a slow speed "up" contact bar 66, and receiver 51 leads through a connector 67 to a pair of conductors 68,70. The conductor 68 leads to the hoist "creep" power supply control bar 72 (FIG. 4) and the conductor 70 leads to the main "up"-"down" power or current supply control bar 74. The receiver 52 leads to a pair of conductors 76,78 each of which includes a diode 80 and a terminal 82 (FIG. 4), from which extend conductors 84,86.

The conductor 84 leads to a terminal end 87 of a "normally open" switch plate 88 which is of the leaf spring type and is supported at its other end by an abutment 89 formed in the molded body member 20. This switch provides the "creep" control system for the hoist as will be explained more fully hereinafter. The conductor 86 leads to the high speed "up" contact bar 90 (FIGS. 4 and 5), and a branch conductor 92 (FIG. 5) leads to the high speed "down" contact bar 94. As best shown at FIGS. 4 and 5, the current supply bar 74 and the switch bars 64,66,90 and 94 are slide-fitted at their opposite ends within grooves 64*a*, 66*a*, 90*a* and 94*a* formed in the body member 16 and are held therein at various elevations relative to the coil spring 30 (FIG. 4) by means of abutments 64*b*, 66*b*, 90*b* and 94*b* molded as part of and extending inwardly from the cover plate 27, after and as long as it is locked in such operative position by the resilient covering sheath 42 as explained hereinabove.

Figure 2:
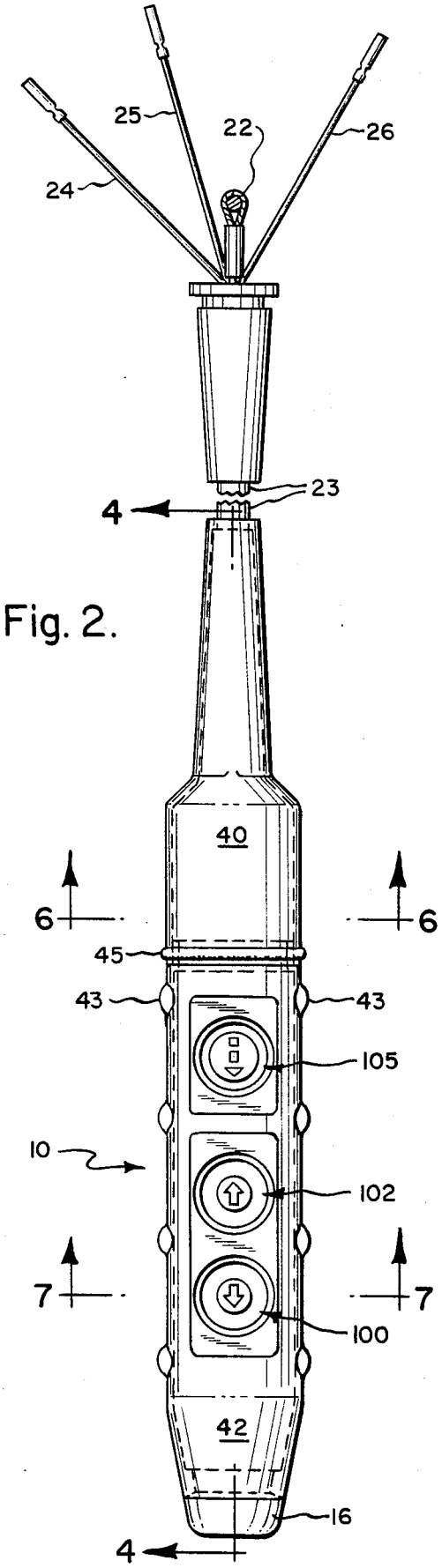
FIG. 2 is a front elevational view of a pendant type push button control station for such an electric hoist or the like, constructed in accordance with the present invention.

As shown at FIGS. 2 and 4, the front panel portion of the sheath member 42 is so molded as to include circularly embossed portions 100,102 which provide operator control finger guidances or buttons arranged in alignment with apertures 32 and 34 for applying pressures therethrough against the coil spring 30 so that it is resiliently deflected from its normally "switch open" position to either "up" and "down" operations of the controlled hoist. As best shown at FIG. 4, these embossed sections include annularly shaped resilient collar portions 104 and inwardly directed centrally disposed "post" portions 106 which operate upon the spring 30 to press it into electrical circuit closings (via the main power supply contact 74) with the optional contact members 64,66,90,94.

Thus, as shown by way of example at FIG. 8, when the operator's "button" 100 is pressed upon to a first degree, the post portion 106 thereof deforms the spring 30 so as to contact member 64 to complete a power circuit calling upon the hoist brake to open and the hoist motor to run in the load-lowering direction at a relatively slow speed. However, upon further depression of the "button" 100, the spring 30 is further deformed so as to make contact with the member 94 as shown at FIG. 9, whereby the hoist motor will be run at a higher speed. Similar operations of the control "button" 102 of the device will cause either slow or high speed "up" operations of the motor, and similar operations of the control "button" 105 will operate the leaf spring switch 88 so as to cause the hoist motor and brake systems to "creep" the load in the down direction and/or to "precisely position" the load as desired. Details of such associated control systems comprising no part of the present invention are explained for example in U.S. Pat. No. 4,361,312.

A resilient complementary switch operation control bar device 110 (FIGS. 4, 8 and 9) for the coil spring 30 is preferably employed, such as is shown herein as comprising a solid "torpedo" shaped member press-fitted at its mid-section largest diameter portion into a centralized position inside the coil spring 30 in opposition between a lateral abutment portion 112 of the body member 10 and the power supply contact bar 74. Thus, upon operation of either of the control "buttons" 100,102, the bar 110 rocks inside the spring 30 upon that portion thereof which is fulcrumed on the supply contact 74, and thereupon operates as an interlock control device, because it prevents pushing in upon both of the buttons 100 and 102 at the same time. Also, the bar 110 operates to assist the spring 30 to break away from any tendencies to become welded into attachments with the contact members 64,66,90,94 incidental to operation of the device. Furthermore, in the event that the action of the spring per se is not sufficient to break it away from any such weldment, the operator may simply press in upon the control "button" at the opposite end of the bar 110, whereupon the latter will operate to positively break the weldment. This device contributes substantially to precision responses by the control station to operator endeavors for effective controls of the system, notwithstanding the operator may, through necessity, be wearing cumbersome hand gloves at the time. Incidentally, it is to be understood that in lieu of the use of a helically wound coil spring as shown at 30, a suitably resilient tubular member formed of electrically conductive (or coated) plastic material or the like may be employed.

Furthermore, in the case of the present invention the consolidated cable 23 including the "strain relief" cable 22 entering the control pendant per se is carried through a throttling 120 (FIGS. 3, 4 and 5) and thereupon emerges inside the device of the invention as best shown at FIGS. 4, 5 and 6. This collar 120 may be for example of the self-locking tie type made of nylon or the like, and provides at once a fluid-tight seal relative to the internally disposed electrical components of the device, and also mechanically locks together the ends of the body member 10 and cable 23. The strain relief cable terminates in the form of a loop around an anchor post 122 which extends from front to rear through a suitably apertured portion of the body and cover portions 20,27 of the assembly. As best shown at FIG. 4, the anchor post 122 device may by way of example comprise an internally threaded thimble 124 into which a threaded screw 126 is engaged.

Thus, it is to be appreciated that for purposes of field replacements of the control station, the shield sleeves 40,42 need only be peeled up and down, respectively, and thus away from the body of the devices whereupon the cover 27 may be readily removed. This permits access to the interior of the electrical component compartment, whereby the dependent conductors 24,25,26 may be withdrawn from receivers 50,51,52. The screw 126 is then readily removed so as to free the entire control station from the depending cable 23 such as for repair/replacement purposes such as may be required. A strain spreader plate 130 (FIGS. 4 and 7) of resilient tensile strength material which is apertured to fit upon the anchor post is preferably employed. This plate may be adhesively or otherwise attached to the body member 10 and is shaped to laterally extend the distribution of the cable strains within the body member. Incidentally, via use of insulating panels 132,134, a base plate arrangement for supporting the associated wiring components is also provided.

We claim:

1. An electrical switch apparatus of the type adapted to be suspended by means of a cable comprising a load supporting carrying strand accompanied by electrical conductor members extending from an overhead hoist being controlled thereby, said apparatus comprising in combination:

an elongated body member having upper and lower ends and defining an open cavity and apertures communicating with said cavity, said body member being formed of an electrically non-conductive and a relatively stiff resilient material;

a cover plate formed of an electrically non-conductive and relatively stiff resilient material detachably connected to said body member so as to cover said cavity opposite to said apertures, said body member and said cover plate cooperating to provide a peripherally extending mounting groove arranged intermediate said apertures and said upper end of said body member;

switching mechanisms positioned within said cavity in alignment with said apertures and detachably connected electrically to said conductor members;

means for detachably connecting said upper end of said body member to depend from said carrying strand; and generally tubular shaped upper and lower sheath members formed of an electrically non-conductive and highly resilient material removably fitted over said upper and lower ends of said body member to cover said body member and said cover plate in a waterproof and electrically insulated manner with adjacent ends of said sheath members being arranged in a lapped relation above said mounting groove, said lower sheath member having portions thereof arranged in alignment with said apertures serving to define buttons adapted for manual depression for selectively operating said switching mechanisms, said lower sheath member having an internal flange portion removably received within said mounting groove and having an outwardly facing peripheral groove to provide a locking depression for receiving a lapped end of said upper sheath member retained in place by an elastic ring extending peripherally thereof, and said upper sheath member having an extended tubular shaped end portion slide-fitted about said cable in moisture sealing relation therewith and operating to brace said cable against sharp bends adjacent to said body member.

2. An electrical switch apparatus according to claim 1, wherein said lower end of said body member is provided with another peripherally extending mounting groove and said lower sheath member is provided with another internal flange portion removably received within said other mounting groove.

3. An electrical switch apparatus according to claim 1, wherein said switch mechanisms include an elongated resiliently deformable electrical contact member supported at its opposite ends to extend lengthwise thereof within said cavity and transversely in alignment with a pair of said apertures, a current supply bar arranged in said cavity for engagement with said contact member adjacent a mid-point thereof, and two pairs of electrical contacts supported within said cavity in alignment one pair with each of said pair of apertures and on a side of said contact member spaced therefrom, said supply bar is arranged intermediate said buttons aligned with said pair of apertures and on a side of said contact member opposite said buttons, said buttons aligned with said pair of apertures when pressed upon to a first degree being operable to deform said contact member transversely thereof into engagement with a first contact of an aligned one of said pairs of said contacts and when pressed upon to a further degree further deforming said contact member into engagement with a second contact of said aligned one of said pairs of contacts, and means for preventing deformation of said contact member by said buttons simultaneously into engagement with said two pairs of contacts.

4. An electrical switch apparatus according to claim 3, wherein said contact member is tubular and said means for preventing simultaneous engagement includes a control bar device fixed within said contact member adjacent said mid-point thereof.

5. An electrical switch apparatus according to claim 3, wherein said contacts are in the form of bars arranged to extend transversely of said contact member, said body member is formed with grooves for receiving opposite ends of said bars, and said bars are retained within said grooves by abutments extending inwardly of said cavity from said cover plate.

6. An electrical switch apparatus of the type adapted to be suspended by means of a cable from an overhead hoist to be controlled thereby, said switch apparatus comprising in combination:

a body member formed of an electrically non-conductive and relatively stiff resilient material having a cavity and a pair of apertures opening into said cavity;

sheath means formed of an electrically non-conductive and highly resilient material enclosing said body member and defining push-operated buttons aligned one with each of said apertures;

an elongated resiliently deformable electrical contact member supported by its opposite ends to extend lengthwise thereof within said cavity and transversely in alignment with said apertures; a current supply bar arranged in said cavity for engagement with said contact member adjacent a mid-point thereof, said supply bar being disposed intermediate said buttons and on a side of said contact member spaced from said buttons; and two pairs of electrical contacts supported within said cavity in alignment one pair with each of said buttons and on a side of said contact member spaced from said buttons, and each of said buttons when pressed upon to a first degree being operable to deform said contact member transversely thereof into engagement with a first contact of an aligned one of said pairs of contacts and when pressed upon to a further degree, further deforming said contact member into engagement with a second contact of said aligned one of said pairs of contacts.

7. A switch apparatus according to claim 6, additionally including in combination means for preventing deformation of said contact member by said buttons simultaneously into engagement with said pairs of contacts.

8. A switch apparatus according to claim 7, wherein said contact member has a tubular configuration, and said means for preventing simultaneous engagement includes a control bar device fixed within said contact member adjacent said mid-point thereof.

9. A switch apparatus according to claim 8, wherein said contact member is a coil spring.

10. A switch apparatus according to claim 6, wherein a side of said cavity opposite to said apertures is closed by a cover plate formed of an electrically non-conductive and relatively stiff resilient material fixed to said body member and enclosed therewith by said sheath means, said contacts are in the form of bars arranged to extend transversely of said contact member, said body member is formed with grooves for receiving opposite ends of said bars, and said bars are retained within said grooves by abutments extending inwardly of said cavity from said cover plate.

11. A switch apparatus according to claim 6, wherein said contact member is a coil spring and a control bar device is fixed within said spring and adapted to rock upon said mid-portion of said spring engaged with said current supply bar and prevent pushing in on said buttons to cause said spring to simultaneously engage both said pairs of contacts.

* * * * *